US007086500B2

(12) United States Patent
Moss et al.

(10) Patent No.: US 7,086,500 B2
(45) Date of Patent: Aug. 8, 2006

(54) EXTENSIBLE, SELF LOCKING PLATFORM AND METHOD OF USING SAME

(75) Inventors: N. Ryan Moss, Springville, UT (US); Darius S. Penrod, Elberta, UT (US)

(73) Assignee: Wing Enterprises, Inc., Springville, UT (US)

( * ) Notice: Subject to any disclaimer, the term of this patent is extended or adjusted under 35 U.S.C. 154(b) by 0 days.

(21) Appl. No.: 10/699,619

(22) Filed: Oct. 31, 2003

(65) Prior Publication Data

US 2005/0115767 A1 Jun. 2, 2005

(51) Int. Cl.
*E06C 7/16* (2006.01)
*E04G 1/15* (2006.01)

(52) U.S. Cl. ..... 182/119; 182/116; 182/222; 182/223

(58) Field of Classification Search ..... 182/119, 182/222, 223, 117, 121, 178, 179, 118, 122, 182/116; 108/102, 137, 65, 159.11; 403/104, 403/112, 181, 186, 343, 364, 63
See application file for complete search history.

(56) References Cited

U.S. PATENT DOCUMENTS

| | | | | | |
|---|---|---|---|---|---|
| 391,182 | A | * | 10/1888 | Nosker | 182/17 |
| 510,057 | A | * | 12/1893 | Williams | 182/119 |
| 711,384 | A | * | 10/1902 | Carman | 182/119 |
| 1,267,618 | A | * | 5/1918 | Andersen | 182/223 |
| 1,359,452 | A | * | 11/1920 | Walker | 182/222 |
| 2,069,969 | A | | 2/1937 | Nelson | |
| 2,656,223 | A | * | 10/1953 | Gray | 182/119 |
| 3,145,668 | A | * | 8/1964 | Pantazos | 108/93 |
| 3,703,220 | A | | 11/1972 | Williams et al. | |
| 3,765,509 | A | * | 10/1973 | Taylor | 182/222 |
| 3,790,417 | A | * | 2/1974 | Paterson et al. | 156/62.8 |
| 5,000,290 | A | * | 3/1991 | Seely | 182/222 |
| 5,067,589 | A | | 11/1991 | Bartnicki | |
| 5,358,069 | A | * | 10/1994 | Krause | 182/118 |
| 5,401,315 | A | * | 3/1995 | Salo et al. | 118/225 |

(Continued)

FOREIGN PATENT DOCUMENTS

DE 74 07 390 U 5/1974

(Continued)

OTHER PUBLICATIONS

International Search Report, dated Mar. 24, 2005, 4 pages.

*Primary Examiner*—Hugh B. Thompson, II
(74) *Attorney, Agent, or Firm*—TraskBritt

(57) ABSTRACT

An extensible, self locking platform includes a first assembly having a first plurality of substantially parallel longitudinally extending members and a second assembly having a second plurality of substantially parallel longitudinally extending members. The first and second assemblies are longitudinally, slidably coupled with each other. The platform may also include one or more catch devices. In one embodiment, at least one catch member is pivotably coupled to the first assembly with an associated stop member. The stop member is configured to maintain a rotation of the at least one catch member at less than a full revolution such that when the catch member is being abutted against an elevated support structure and the platform is being laterally displaced relative thereto, the catch member will also abut the stop member and prevent further displacement of the platform relative to the elevated support structure.

21 Claims, 9 Drawing Sheets

U.S. PATENT DOCUMENTS

| | | | | |
|---|---|---|---|---|
| 5,704,449 | A * | 1/1998 | Ono | 182/119 |
| 5,762,441 | A | 6/1998 | Karlsen et al. | |
| 5,862,881 | A | 1/1999 | O'Brien | |
| 6,318,499 | B1 * | 11/2001 | Honein et al. | 182/222 |
| 2003/0226714 | A1 * | 12/2003 | Masino | 182/119 |

FOREIGN PATENT DOCUMENTS

| | | | | |
|---|---|---|---|---|
| DE | 296 19 314 | U1 | 1/1997 | |
| EP | 0 702 120 | A1 | 3/1996 | |
| GB | 2074225 | A * | 10/1981 | |
| GB | 2198777 | * | 6/1988 | 182/119 X |

* cited by examiner

EXTENSIBLE, SELF LOCKING PLATFORM AND METHOD OF USING SAME

BACKGROUND OF THE INVENTION

1. Field of the Invention

The present invention relates generally to platforms or support structures and, more specifically, to a platform including a self-locking mechanism.

2. State of the Art

In many circumstances, it becomes desirable to provide a temporary elevated working surface for the support of one or more individuals. For example, in the construction industry, it is often necessary to perform work on a ceiling, the upper section of a wall, or some other elevated structure. Such an activity might include, for example, hanging drywall, painting, applying stucco, laying brick or performing remedial work on a given structure.

Various structures are used to provide such an elevated working surface. For example, various types of ladders are often used to provide access to an elevated location. However, ladders only provide an elevated working surface for a limited lateral work area. Thus, if one's work or activity requires access to an area spread over a relatively large lateral distance, use of a ladder requires repeated ascent, descent and moving of the ladder to perform the activity. Additionally, a ladder conventionally only provides an elevated working surface for one individual at a time.

Another structure which provides an elevated working surface is a scaffold. A scaffold includes a framework which supports one or more elevated planks or platforms. The platforms generally provide a horizontally or laterally extending surface on which one or more individuals may access a relatively large area at a desired vertical elevation. The planks or platforms are conventionally movable and may be repositioned vertically and/or horizontally thereby providing considerable flexibility with regard to the elevated areas a user may access thereby.

Scaffolding, while providing relatively good access to elevated areas for one or more individuals, often requires time consuming assembly and disassembly of the scaffold framework when it is desired to laterally move the scaffolding any significant distance. Thus, in instances where the work to be performed by an individual requires substantial continual lateral movement over a relatively short period of time, scaffolding becomes a cumbersome and inefficient solution.

Another solution which has been employed is the use of a plank or platform placed on a pair of elevated supports. For example, a wooden plank may be placed on a pair of supports, often referred to as ladder jacks, with the supports each being structurally coupled to one of a pair of spaced apart ladders. In a more simple arrangement, the plank may be placed directly on a rung of one of a pair of spaced apart step ladders. Other platforms, including longitudinally extensible platforms such as are shown in U.S. Pat. Nos. 3,703,220 issued Nov. 21, 1972, and U.S. Pat. No. 5,067,589 issued Nov. 26, 1991, maybe used in a similar manner with a pair of laterally spaced supports.

The use of a plank or platform with a pair of readily movable, laterally spaced supports provides an elevated working surface for one or more individuals and for a relatively large working area. Furthermore, such an arrangement allows for simple relocation of the elevated working surface and transportation thereof from one location to another. Additionally, the use of extensible planks, such as disclosed in the above-referenced U.S. Patents, in conjunction with a pair of laterally spaced supports offers additional flexibility by providing an elevated working surface for a variety of circumstances, locations and configurations. For example, an extensible platform may be longitudinally extended to provide an elevated working surface over a relatively wide horizontal distance and may be subsequently contracted for use in a relatively tight space. Additionally, such a platform may be contracted for storage and transportation thereof.

While, the arrangement of a plank or platform supported by a pair of laterally spaced supports provides a convenient and flexible solution in many circumstances, various functional and safety issues may arise in utilizing such an arrangement. For example, the simple placement of a plank or platform on top of a pair of supports gives rise to a situation where the end of the plank or platform may slip off one of the supports and cause the plank or platform, and anyone (or anything) supported thereby, to fall. Such slippage between the plank or platform and its supports may be due to, for example, continued lateral movement of an individual on the platform resulting in a series of small displacements of the platform relative to the supports. Also, slippage may occur between a platform and its supports when a user supported thereby applies a lateral force to a portion of an elevated structure thereby inducing a reactionary force within the platform and displacing the platform relative to its supports.

Some types of planks or platforms include one or more fixed hooks or similar structural members at each longitudinal end thereof configured to engage a cross-member of the laterally spaced supports and prevent relative lateral displacement therebetween. However, the use of fixed hooks to engage a support limits the flexibility of such an arrangement with respect to the relative placement of the plank or platform and the laterally spaced supports. Additionally, the use of fixed hooks assumes that the supports have an appropriately sized and configured cross-member for cooperative engagement therewith. In other words, the use of hooks to prevent lateral displacement of the plank or platform relative to its supports can be limiting with regard to which structures may be used as supports.

In view of the shortcomings in the art, it would be advantageous to provide a platform, including a longitudinally extensible platform, which provides an automatic lock or catch mechanism for preventing relative lateral displacement with a support member. It would also be advantageous to provide such a platform which is able to engage with a variety of support members to provide additional flexibility in its use as an elevated working surface.

BRIEF SUMMARY OF THE INVENTION

In accordance with one aspect of the invention, a platform assembly is provided. The platform assembly includes a first assembly having at least one longitudinally extending member and a second assembly having at least one longitudinally extending member. The second assembly is longitudinally, slidably coupled with the first assembly. At least one catch member is pivotably coupled to the first assembly. At least one stop member is also coupled to the first assembly and configured to maintain a rotation of the at least one catch member at less than a full revolution thereof.

In accordance with another aspect of the present invention, a method of securing an elevated platform is provided. The method includes providing a first elevated support and providing a first catch member with an associated stop member on the platform. At least a first portion of the platform is laterally displaced in a first direction until the catch member is positioned substantially beyond the at least a portion of the first elevated support. The at least a first portion of the platform is then displaced laterally in a second direction until the first catch member engages the at least a portion of the first elevated support. The at least a first portion of the platform is further displaced laterally in the second direction while the first catch member is substantially simultaneously rotated in a direction towards the associated stop member. The first catch member is abutted against the associated stop member and against the at least a portion of the first elevated support such that the first catch member prevents further displacement of the at least a first portion of the platform in the second lateral direction.

The method may further include providing a second elevated support laterally spaced from the first elevated support and providing a second catch member with an associated stop member on the platform. A second portion of the platform may be laterally displaced relative to the at least a first portion of the platform in the second direction until the second catch member is positioned substantially beyond the at least a portion of the second elevated support. The second portion of the platform may then be laterally displaced relative to the at least a first portion of the platform in the first direction until the second catch member engages the at least a portion of the second elevated support. The second portion of the platform is then further displaced laterally relative to the at least a first portion of the platform in the first direction while the second catch member is substantially simultaneously rotated in a direction towards its associated stop member. The second catch member is abutted against its associated stop member and against the at least a portion of the second elevated support such that the second catch member prevents further displacement of the second portion of the platform in the first lateral direction.

In accordance with another aspect of the invention, another platform assembly is provided. The platform assembly includes a first assembly having at least one longitudinally extending member and a second assembly having at least one longitudinally extending member. The second assembly is longitudinally, slidably coupled with the first assembly. At least one catch device is associated with the first assembly and positionable between a first position wherein a body portion of the at least one catch device projects from a first surface of the first assembly and a second position wherein the body portion projects from a second opposing surface of the first assembly.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1A:
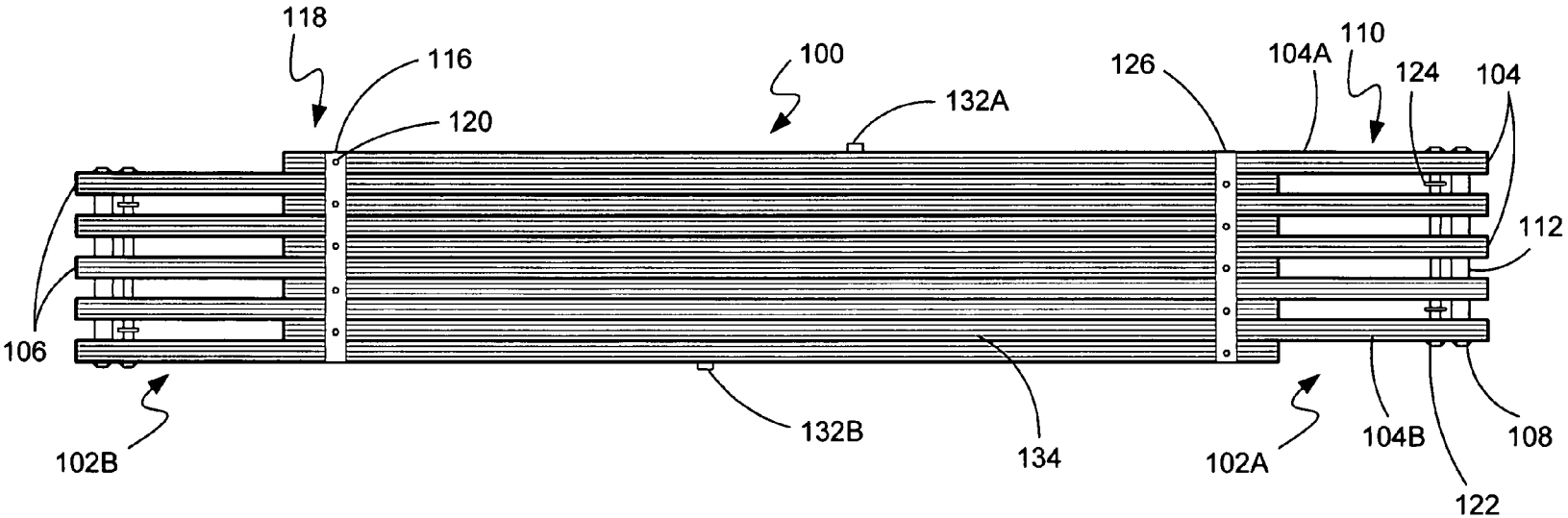
FIGS. 1A and 1B show plan and elevational views of a platform in accordance with an embodiment of the present invention.
Figure 1B:
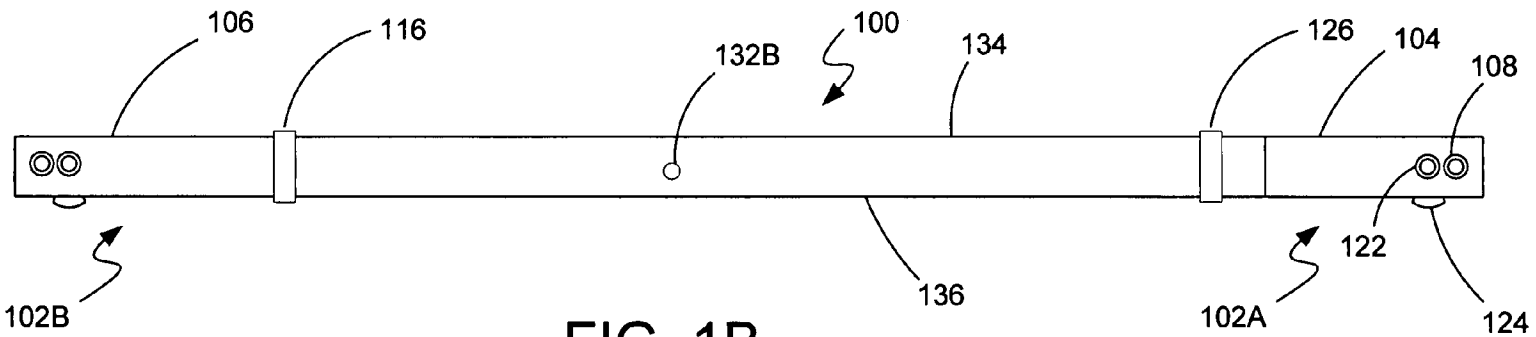

Referring to FIGS. 1A and 1B, an extensible platform 100 is shown in accordance with an exemplary embodiment of the present invention. The extensible platform 100 includes a first assembly 1 02A including a plurality of spaced-apart, longitudinally extending structural members 104. The structural members 104 of the first assembly are interleaved with a corresponding second assembly 102B which includes a plurality of spaced-apart, longitudinally extending structural members 106. For sake of convenience, the longitudinally extending structural members 104 and 106 will be referred to hereinafter as longitudinal members. The longitudinal members 104 of the first assembly 102A are longitudinally slidable relative to the longitudinal members 106 of the second assembly 102B. The relative movement of the first and second assemblies 102A and 102B enable the platform 100 to longitudinally extend and contract and thereby provide a platform of various lengths depending on the various and changing needs of a user of such a platform. It is noted that, while the exemplary embodiment of FIGS. 1A and 1B is described in terms of a plurality of longitudinal members, in another embodiment, each assembly 102A and 102B could include a single longitudinally extending member with, for example, a longitudinally extending member of the first assembly 102A being slidably coupled to the longitudinally extending member of the second assembly 102B as will be appreciated by those of ordinary skill in the art.

With the first and second assemblies being substantially mirror images of each other (about both the horizontal and vertical axes as viewed in FIG. 1A), only the first assembly 102A will be described in detail below for sake of convenience.

The first assembly 102A includes a first lateral support member 108 at or adjacent a first end 110 of the assembly 102A. More specifically, the first lateral support member 108 serves to tie or fix the longitudinal members 104 relative to one another. Additionally, a plurality of spacers 112 may be used to fix the lateral position of each longitudinal member 104 relative to each adjacent longitudinal member 104. Such spacers are configured to exhibit a width substantially equal to the width of a longitudinal member 106 of the second assembly 102B. Thus, the spacers 112 and the longitudinal members 106 of the second assembly 102B serve to establish a substantially parallel relationship of the longitudinal members 104 of the first assembly 102A. The first lateral support member 108 may be fixed to one more of the longitudinal members as desired. However, with the use of appropriate spacers 112, it may only be necessary to fix the lateral support member 108 to the two outer longitudinal members 104A and 104B.

Figure 2:
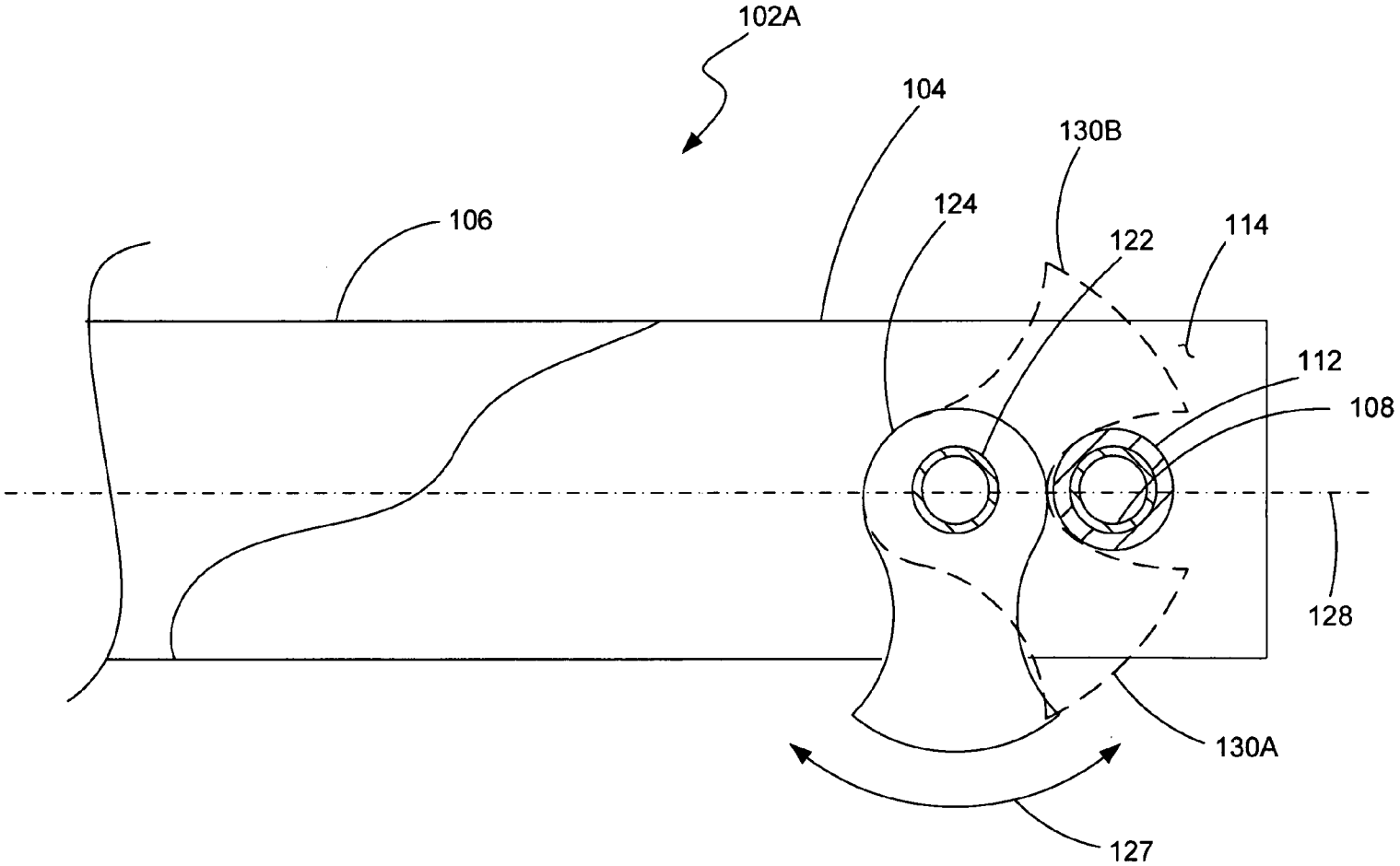
FIG. 2 is a partial sectional elevational view showing one end of a platform in accordance with an embodiment of the present invention.

Referring briefly to FIG. 2 which shows a partial sectional view of one end of the first assembly 102A, the first lateral support member 108 may include, for example, a section of tubing which fits within and extends through corresponding openings formed in the longitudinal members 104. The spacers 112 may, for example, be configured as individual sections of tubing which exhibit an inside diameter substantially similar to the outside diameter of the first lateral support member 108 and configured to slide or slip thereover. The spacers 112 may then be configured such that their outside diameters are larger than the corresponding openings formed in the longitudinal members 104 such that they abuttingly contact the side 114 of each adjacent longitudinal member 104. Referring back to FIGS. 1A and 1B, the first lateral support member 108 may be coupled to the outer longitudinal members 104A and 104B by, for example, swaging the ends of the tubing member. Of course, the first lateral support member 108 may be coupled to the longitudinal members 104 in other ways such as by adhesive, welding, brazing, or via other mechanical fasteners depending, for example on the materials of construction of both the first lateral support member 108 and the longitudinal members 104.

Still referring to FIGS. 1A and 1B, a second lateral support member 116 is coupled to the longitudinal members 104 at the opposing end 118 of the first assembly 102A. In one embodiment, the second lateral support member 116 may be configured to wrap around the first assembly 102A as well as the longitudinal members 106 of the second assembly. The second lateral support member 116 may desirably be coupled to each of the longitudinal supports 104 of the first assembly 102A. Such coupling may be effected by, for example, mechanical fasteners 120 (e.g., rivets or screws), welding, brazing, or application of an appropriate adhesive. The second lateral support member 116 is not fixed to the longitudinal members 106 of the second assembly 102B but, rather, is configured to slide longitudinally relative thereto. While being slidable relative to the second assembly 102B, the wrapping of the second lateral support member 116 about the second assembly 102B also serves to laterally and vertically tie the two assemblies together (as does the similarly configured lateral support member 116 associated with the second assembly 102B).

A cross member 122 may be coupled to the first assembly 102A adjacent the first lateral support member 108. While not necessarily acting as such, the cross member 122 may also be used as a lateral support member if so desired. One or more self-locking, catch members 124 are pivotably coupled with the cross member 122. Referring back to FIG. 2, the cross member 122 may formed of, for example, tubing extended through corresponding openings in the longitudinal members 104. The cross member 122 may be coupled to at least the outer two longitudinal members 104A and 104B (FIG. 1A) in a manner similar to that of the first lateral support member 108. For example, the cross member 122 may be coupled to the outer longitudinal members 104A and 104B (FIG. 1A) by, for example, swaging the ends of the tubing, by means of adhesive, welding, brazing, or via other mechanical fasteners. In another embodiment, the multiple cross members 122 are each coupled with adjacent longitudinal members 104.

As indicated by bidirectional arrow 127, the catch member 124 is pivotably coupled with the cross member 122. An exemplary catch member 124 may exhibit a substantially bell-shaped cross-sectional geometry as taken substantially parallel to the longitudinal axis 128 of the longitudinal members 104. Such a geometry may be advantageous in effecting the locking of the catch member 124 relative to a support structure as will be discussed in further detail below. Other suitable geometries may also be employed.

It is noted that the spacing between the first lateral support member 108 and the cross member 122 is such that the first lateral support member 108 acts as a stop for the catch member 124 thereby preventing a full 360° revolution of the catch member 124 about the cross member 122. Rather, the catch member 124 may rotate through approximately three fourths to seven-eighths of a full revolution such as indicated by dashed lines at 130A and 130B which show the rotational extents of the catch member 124. Additionally, in one embodiment the rotation of the catch member 124 may desirably be symmetric relative to the longitudinal axis 128 of the longitudinal members 104.

Referring back to FIGS. 1A and 1B, one or more stopping members 132A and 132B may be utilized to limit the longitudinal extension of the first assembly 102A relative to the second assembly 102B. For example, a first stopping member 132A may be coupled to the outer longitudinal member 104A of the first assembly 102A and, upon extension of the two assemblies 102A and 102B, slide towards and into abutting contact with the second lateral support member 126 of the second assembly 102B so as to limit the relative longitudinal extension of the first and second assemblies 102A and 102B. Similarly, a second stopping member 132B may be coupled to a longitudinal member 106 of the second assembly and, upon extension of the two assemblies 102A and 102B relative one another, slide towards and contact the first lateral support member 108 of the first assembly 102A. Other structures or stopping mechanisms may be used if so desired. However, the presently disclosed stopping members, when located on the sides of the first and second assemblies 102A and 102B respectively, are unobtrusive and do not act to inadvertently trip a user of the platform as would occur if they were located on a working surface of the platform.

As indicated in FIG. 1A, the upper surface 134 of the platform 100 and, more particularly, of the longitudinal members 104 and 106, may exhibit a textured surface or have an anti-slip coating disposed thereon. Such a surface or coating may serve to provide traction for a user of the platform 100. Additionally, if desired, such texturing or coating may be similarly provided on the undersurface 136 of the platform such that the platform becomes reversible with both the upper surface 134 and the undersurface 136 being capable of providing a functional working surface and such that, in practical terms, there is little or no distinction to be made between the upper and undersurfaces 134 and 136 of the platform 100.

Figure 3C:
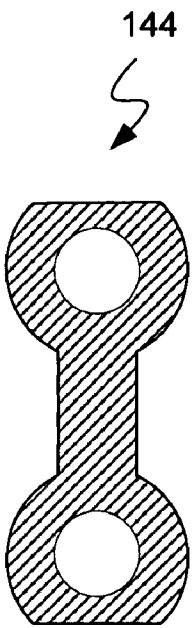
FIGS. 3A–3C show exemplary cross-sectional views of longitudinal members utilized in the platform shown in FIGS. 1A and 1B.
Figure 3B:
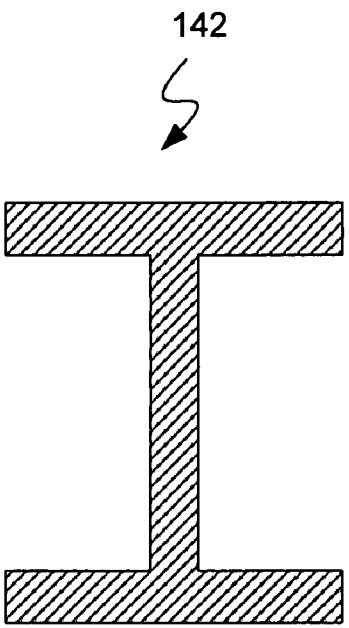
Figure 3A:
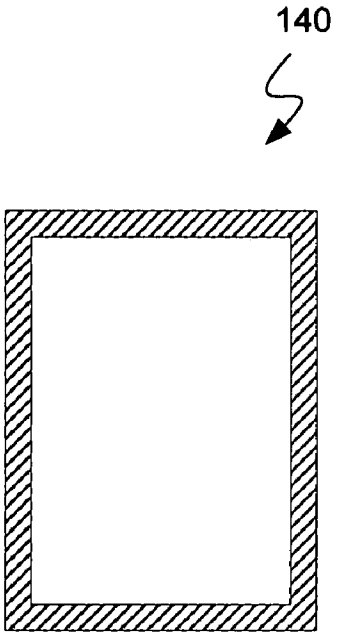

It is noted that the individual longitudinal members 104 and 106 act as structural support members and, in many instances, depending on the support configuration, may be considered as beams which are simply supported at each end. Thus, the longitudinal members 104 and 106 must be of sufficient structural design to provide support to at least one, and desirably a plurality of users with their tools and supplies. Referring briefly to FIG. 3, the longitudinal members may exhibit various cross-sectional configurations as taken transversely to the longitudinal axis 128 thereof (see FIG. 2). Exemplary cross-sectional configurations may include a box-beam 140 or other closed polygonal configuration such as shown in FIG. 3A; a substantial I-beam configuration 142 such as shown in FIG. 3B which may provide for a reduction in material and weight; or a some other configuration such as a "dog-bone" cross section 144 such as shown in FIG. 3C.

Additionally, the longitudinal members 104 and 1.06, as well as other components of the platform 100, may be formed of various materials. For example, the longitudinal members may be formed of various metals and metal alloys including, for example, light weight metals and alloys such as aluminum. Also, such components may be formed of composite materials including, for example, fiberglass or fiber reinforced thermosetting materials.

Figure 4:
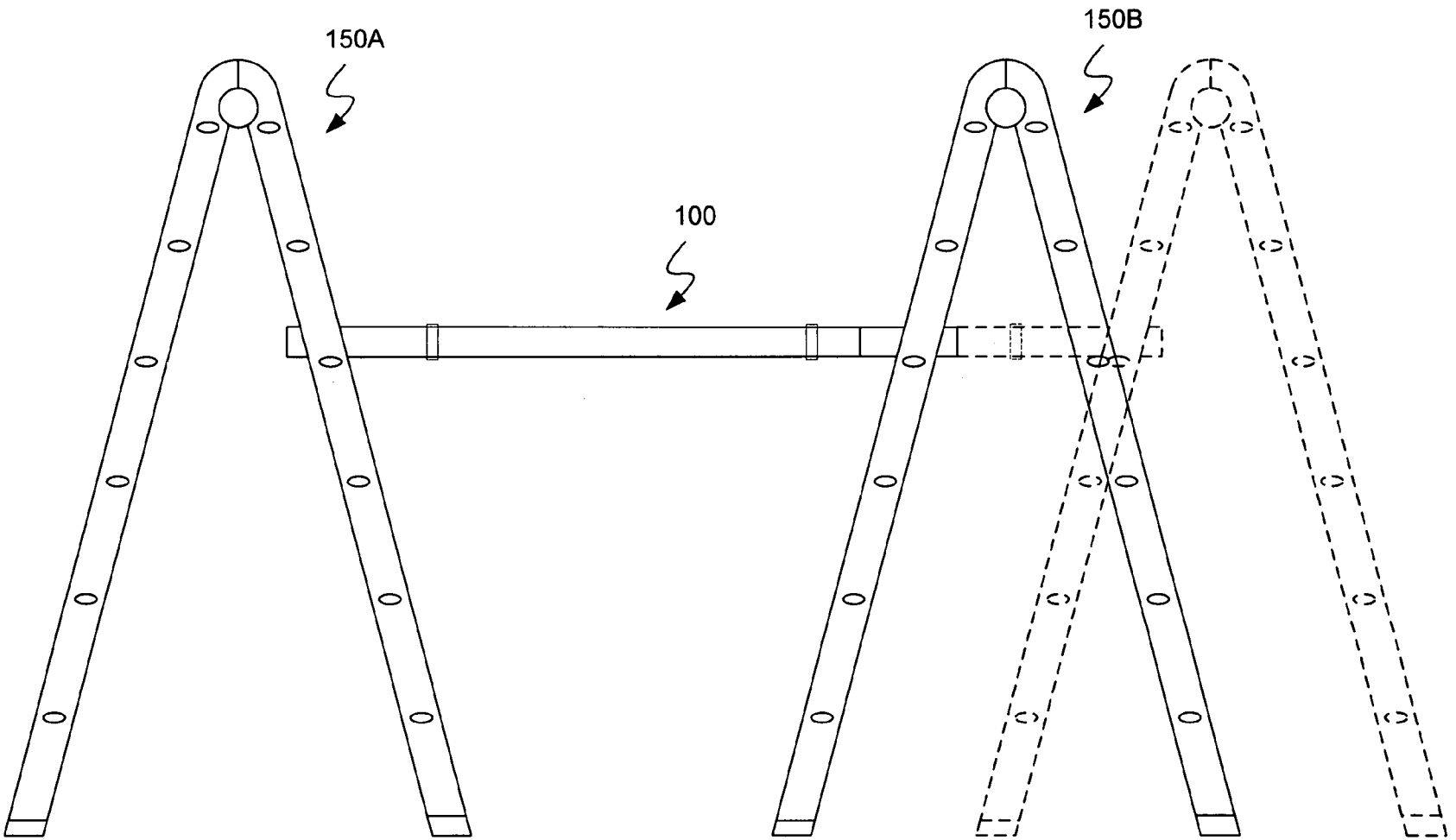
FIG. 4 is a plan view showing a platform placed on a pair of laterally spaced supports in accordance with an embodiment of the invention.

Referring now to FIG. 4, the platform 100 may be placed upon two laterally spaced supports such as, for example, the rungs of a pair of laterally spaced step ladders 150A and 150B. The illustration of step ladders 150A and 150B is exemplary and, as will be appreciated by those of ordinary skill in the art, other support structures may be used including, for example, so-called saw horses, ladder jacks, or other types of ladders including step- or extension-type ladders. Furthermore, it will be understood that one end of the platform 100 may be supported by one type of support, including for example, the tread portion of a step in a set of stairs, while the other end of the platform is supported by a more conventional support such as one of the illustrated step ladders 150A and 150B.

As noted in FIG. 4, the step ladders 150A and 150B may be spaced apart a desired distance with the platform 100 configured to extend the distance therebetween. Depending, for example, on the spatial limitations of a given work area, the ladders may be spaced closer or further apart and the platform 100 may be contracted or extended (such as indicated in dashed lines) to accommodate the spacing of the ladders 150A and 150B or other supports and provide an appropriately sized working surface.

Figure 5A:
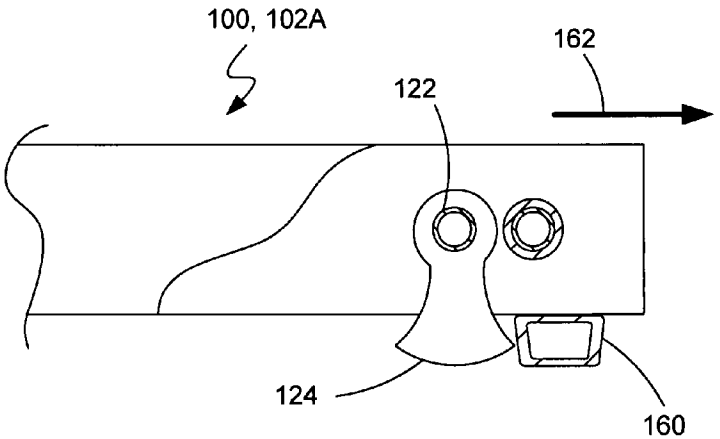
FIGS. 5A–5D show partial sectional elevation views of one end of a platform at various positions relative to a support member in accordance with an aspect of the present invention.
Figure 5B:
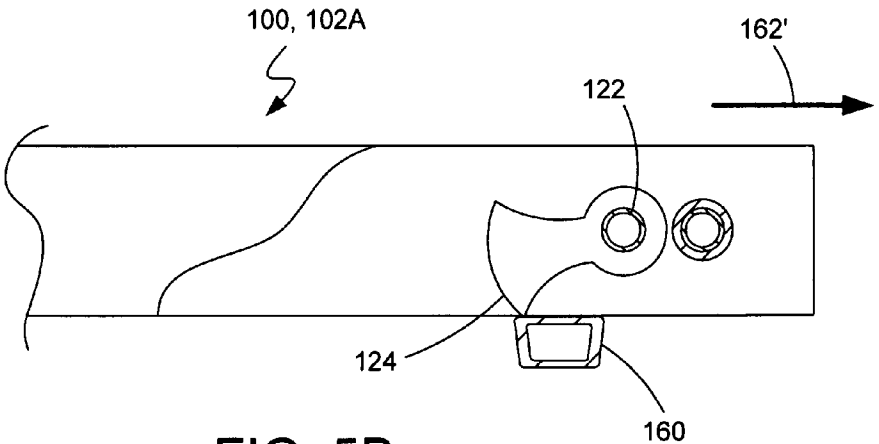
Figure 5C:
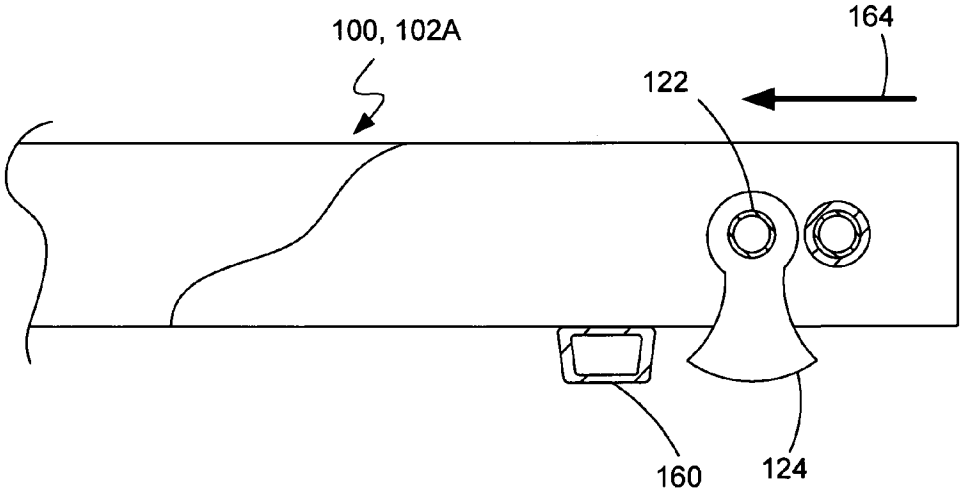

Referring now to FIGS. 5A–5C, the operation of the self-locking catch mechanism is shown and described. Referring first to FIG. 5A, the end of the platform 100, or more specifically, the end of the first assembly 102A of the platform may be placed on a support such as, for example, the rung 160 of a ladder. The platform 100, or at least the first assembly 102A thereof may then be displaced in the direction indicated by directional arrow 162. It is noted that the displacement indicated by directional arrow 162, and discussed in further detail below, essentially involves the displacement of the first assembly 102A, which may occur as a result of extending the first and second assemblies 102A and 102B relative to one another (see FIGS. 1A, 1B and 4). However, the displacement of the first assembly 102A may also indicate that the entire platform 100 is being displaced.

Figure 5D:
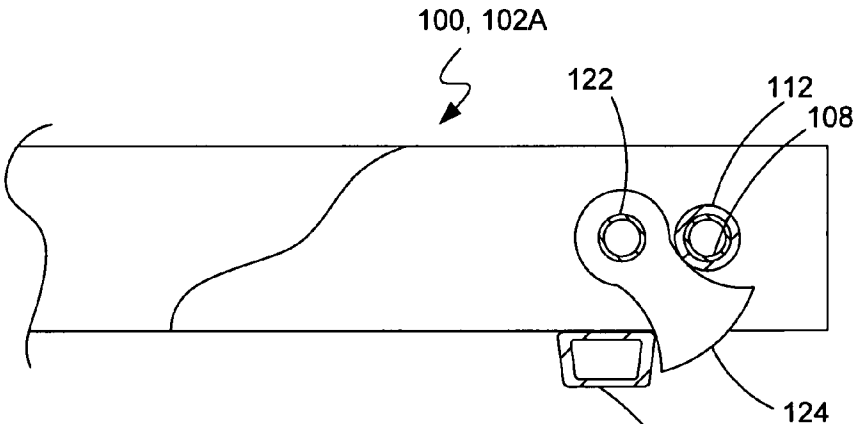

As the first assembly 102A is displaced relative to the rung 160, the catch member 124 may contact the rung 160. As shown in FIG. 5B, if the catch member 124 contacts the rung 160, it will rotate in a first direction about its associated cross member 122 (e.g., clockwise as shown in FIG. 5B) and allow the first assembly 102A to continue in the direction indicated by directional arrow 162'. As the first assembly 102A is displaced even further, the catch member 124 will eventually move beyond the rung 160 at which time it will rotate back to its original position, due to gravity, such as is shown in FIG. 5C. Once the catch member 124 has rotated back to its original position, the first assembly 102A may be displaced in the opposite direction, relative to the rung 160, as is indicated by directional arrow 164. Again, the catch member 124 will come in contact with the rung 160 during such displacement. As shown in FIG. 5D, upon contact with the rung 160, the catch member 124 will rotate in a second direction relative to the cross member 122 (e.g., counter clockwise as shown in FIG. 5D) until the catch member 124 abuts the lateral support member 108 (or its associated spacers 112). When the catch member 124 abuts the lateral support member 108 it acts as a stop member for the platform 100 and keeps the platform from being further displaced relative to the rung 160.

While only described with respect to the first assembly 102A of the platform, the same acts may be performed with the second assembly 102B of the platform such that the platform becomes locked, relative to its supports (e.g., rung 160). Such catch members 124 allow the platform to remain secure relative to its underlying supports such that, when a user is walking back and forth, or applying a lateral force to the platform, the platform will not slip off of its underlying supports.

As indicated earlier, the platform 100 may be reversed relative to its upper surface 134 and undersurface 136 (see FIG. 1B). It is further noted that the design of the catch member 124 also allows such reversal of the platform since, due to gravity, if the platform is flipped upside down, the catch member 124 will naturally rotate to a hanging position such as is shown in FIGS. 1B, 2, 5A and 5C.

Figure 6A:
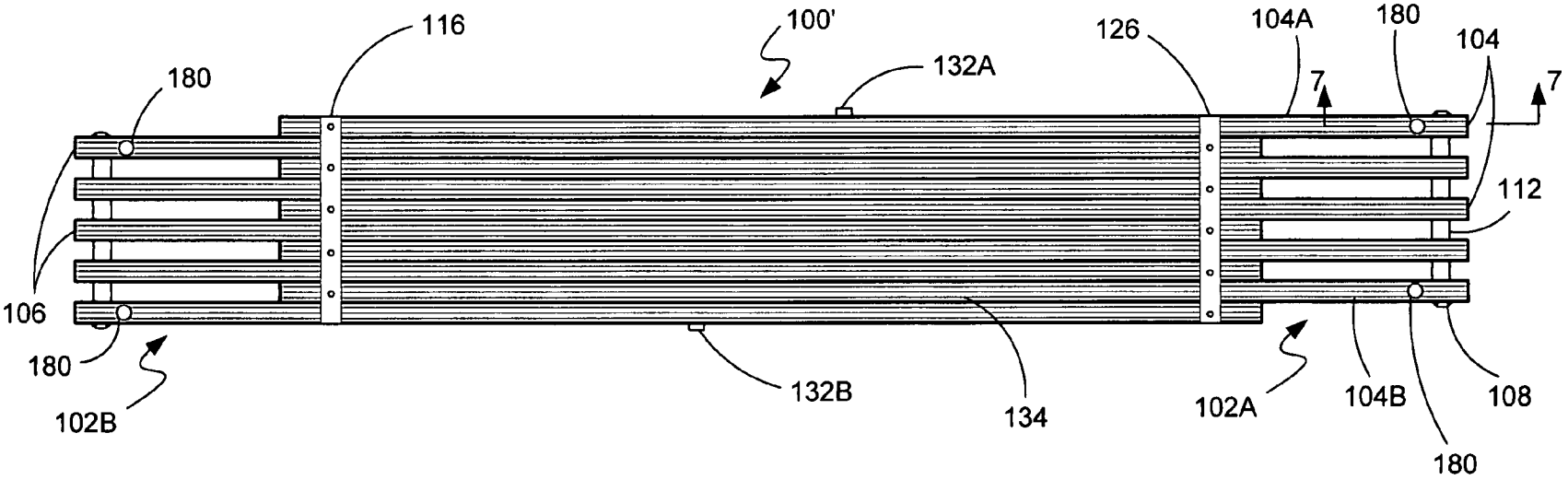
FIGS. 6A and 6B show plan and elevational views of a platform in accordance with another embodiment of the present invention.
Figure 6B:
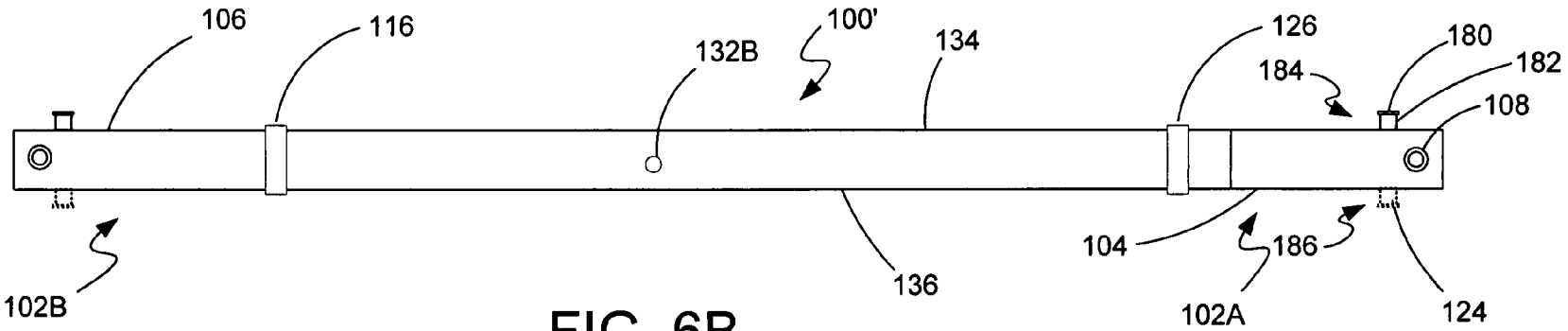

Referring now to FIGS. 6A and 6B, an extensible platform 100' is shown in accordance with another exemplary embodiment of the present invention. The extensible platform 100' is generally similar to the platform 100 described with respect to FIGS. 1A and 1B including a first assembly 102A and second assembly 102B with each including a plurality of spaced-apart, longitudinally extending structural members 104 and 106 respectively. Again, the structural members 104 of the first assembly 102A are interleaved with longitudinally extending structural members 106 of the second assembly 102B such as described above. Each assembly 102A and 102B of the platform 100' may also include a first lateral support member 108 and associated spacers 112. Additionally, the platform 100' may include second lateral supports 116 and 126 and associated stop members 132A and 132B. Thus, the platform 100' provides an extendable working surface for one or more individuals with the first assembly 102A being longitudinally slidable relative to the second assembly 102B to vary the platform's length as set forth above with regard to the platform 100 described with respect to FIGS. 1A and 1B.

Each assembly 102A and 102B may also include one or more catch devices 180. As shown in FIGS. 6A and 6B, the catch devices 180 may include a body portion 182 extending through one or more longitudinally extending members 104 and 106. For example, the catch devices 180 may include a body portion 182 extending through longitudinal members 104A and 104B of the first assembly 102A. The body portion 182 may be movable relative to the longitudinal members 104 between a first position 184, wherein the body extends or projects from the upper surface 134 and is substantially flush with the undersurface 136 of the platform 100', and a second position 186 (shown in dashed lines) wherein the body portion extends or projects from the undersurface 136 and is substantially flush with the upper surface 134 of the platform 100'.

Figure 7:
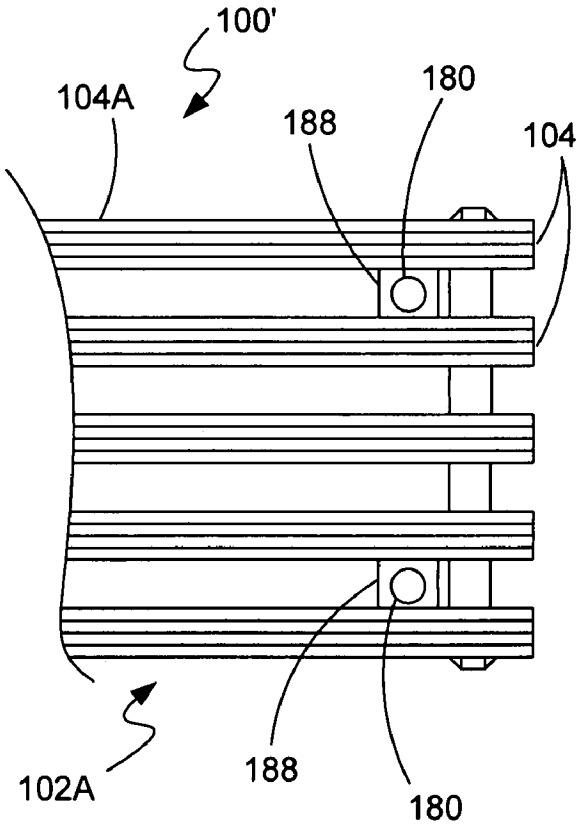
FIG. 7 shows a plan view of a portion of a platform in accordance with yet another embodiment of the present invention.

It is noted, referring to FIG. 7, that the body portion 182 of the catch device 180 need not extend through a longitudinal member 104 but, rather, may be disposed between to adjacent longitudinal members 104. In such a case, a sleeve or collar 188 may be coupled to the two adjacent longitudinal members 104 and the body portion may extend through an opening defined in the sleeve or collar 188. Additionally, while the catch device 180 may include a generally cyclindrically shaped member such as shown in FIG. 6A, other geometries may be utilized.

Figure 8:
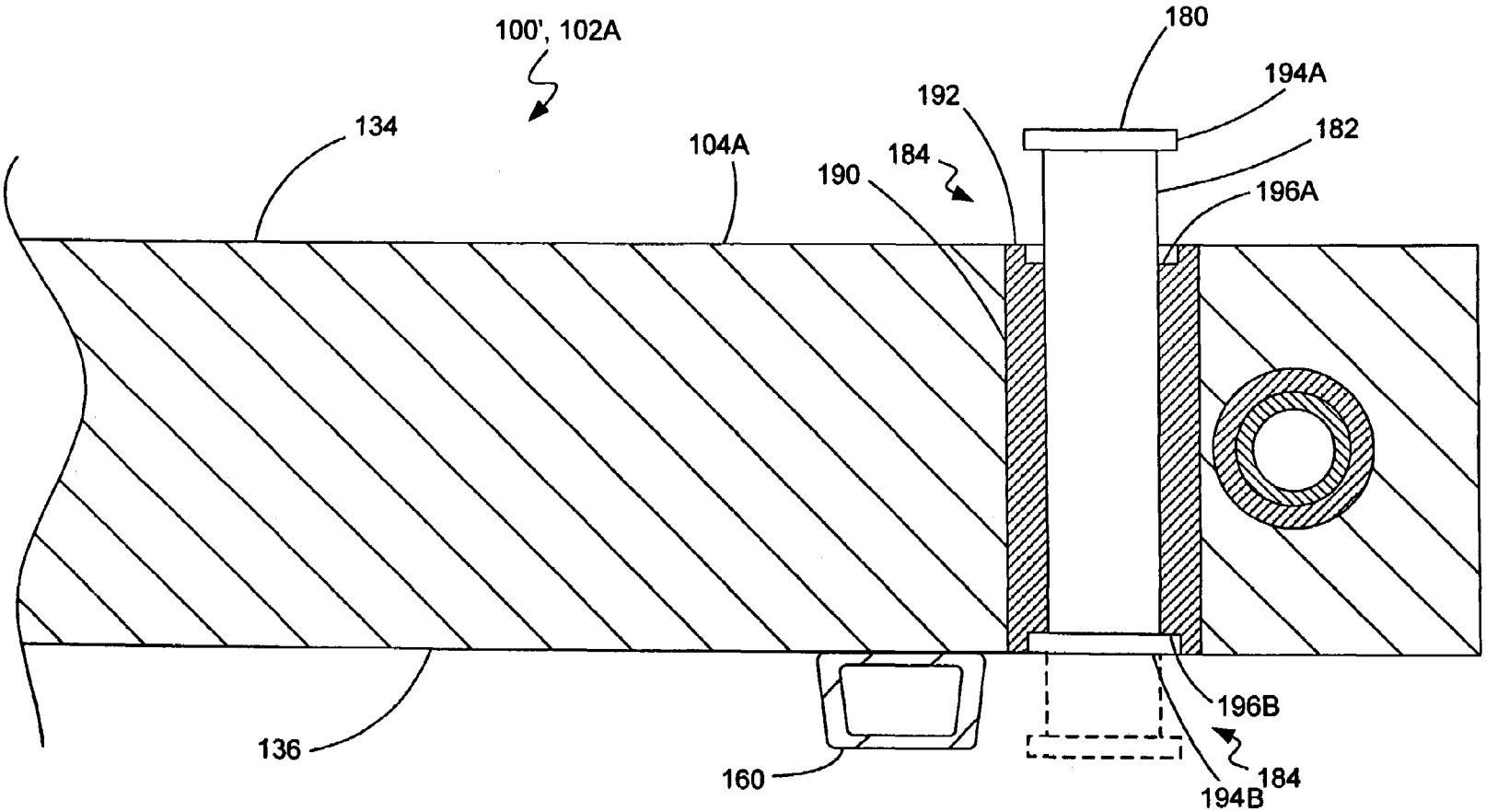
FIG. 8 is a cross-sectional view of a portion of a platform as indicated in FIG. 6A.

Referring now to FIG. 8, a partial cross-sectional view of a longitudinal member 104A and associated catch device 180 is shown in greater detail. As previously noted, the catch device 180 may include a body or body portion 182 disposed through or positioned adjacent to a longitudinal member 104A. In one embodiment, the body portion 182 may extend directly through an opening or channel 190 formed in the longitudinal member 104A. In another embodiment, such as shown in FIG. 8, a sleeve or collar 192 may be disposed within the opening 190 formed in the longitudinal member 104A and the body portion 182 may be disposed within an opening formed in the sleeve or collar 192.

A first flange 194A may be formed at, or coupled to, a first end of the body portion 182 and a second flange 194B may be formed at, or coupled to, a second end of the body portion 182. The sleeve or collar 192 (or the longitudinal member 104A) may exhibit shoulder sections 196A and 196B adjacent the upper surface 134 and the undersurface 136 of the platform 100', respectively. Thus, with the body portion 182 in the first position 184 projecting from the upper surface 134 of the platform 100', the lower flange 1 94B may be received in the shoulder section 196B such that the flange 194B is substantially flush with the undersurface 136. Similarly, when the body portion is in the second position 186, the upper flange 194A may be received in the shoulder section 1 96A such that the flange 194A is substantially flush with the upper surface 134. In another embodiment, shoulder sections 196A and 196B may not be provided and the flanges may simply abut the sleeve or collar 192 or, depending on the configuration, they may directly abut the upper surface and undersurface 134 and 136 of the platform 100'.

In one embodiment, the body portion 182 may be configured to freely slide relative to longitudinal member 104A such that gravity always pulls the body portion 182 downward (towards the ground) regardless of the orientation of the platform 100'. In other words, with the body portion 182 freely slidable relative to the longitudinal member 104A, if the platform was flipped over such that the upper surface 134 and undersurface 136 were reversed, the body portion 182 would automatically be pulled downwardly due to gravity. Such a feature would ensure that the catch device was always ready for engagement with, for example, the rung 160 of a ladder regardless of the orientation of the platform 100'.

In another embodiment, the body portion 182 may be configured to be slidable relative to the longitudinal member 104A, but only upon application of a force by a user of the platform 100'. For example, the body portion 182 may be sized and configured to provide an interfering fit with the sleeve or collar 192 such that it stays in the first position 184, regardless of the effects of gravity, until a user physically pushes the body portion 182 into the second position 186. With the catch device 180 in the second position 186, it may serve as a catch or stop by engaging the rung 160 of a ladder, or the edge of some other support member, to prevent sliding or "walking" of the platform relative to a support member such as described above herein.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A platform assembly comprising:

a first assembly having at least one longitudinally extending member;

a second assembly having at least one longitudinally extending member, the second assembly being longitudinally, slidably coupled with the first assembly, the first assembly and the second assembly cooperatively defining an intended working surface;

at least one catch member pivotably coupled to the first assembly, the at least one catch member being pivotable about an axis that is substantially parallel to the intended working surface and substantially perpendicular to a longitudinal axis of the at least one longitudinally extending member of the first assembly; and at least one stop member coupled to the first assembly and configured to maintain a rotation of the at least one catch member at less than a full revolution.

2. The platform assembly of claim 1, wherein the at least one longitudinally extending member of the first assembly includes a first plurality of substantially parallel longitudinally extending members and wherein the at least one longitudinally extending member of the second assembly includes a second plurality of substantially parallel longitudinally extending members.

3. The platform assembly of claim 2, wherein at least one of the first and second pluralities of longitudinally extending members are each formed of a material comprising aluminum.

4. The platform assembly of claim 2, wherein at least one of the first and second pluralities of longitudinally extending members are each formed of a composite material.

5. The platform assembly of claim 4, wherein the composite material includes fiberglass.

6. The platform assembly of claim 4, wherein the composite material includes a thermosetting resin.

7. The platform assembly of claim 2, wherein at least one longitudinally extending member of the first and second pluralities of longitudinally extending members exhibits a closed polygonal cross-sectional geometry taken substantially transverse to a longitudinal axis thereof.

8. The platform assembly of claim 7, wherein the closed polygonal cross-sectional geometry includes a substantial rectangular geometry.

9. The platform assembly of claim 2, wherein at least one longitudinally extending member of the first and second pluralities of longitudinally extending members exhibits a substantially I-beam shaped cross-sectional geometry taken substantially transverse to a longitudinal axis thereof.

10. The platform assembly of claim 2, wherein the first plurality of longitudinally extending members is interleaved with the second plurality of longitudinally extending members.

11. The platform assembly of claim 2, wherein the first assembly and the second assembly cooperatively define a second, opposing surface relative to the intended working surface, wherein the second, opposing surface is substantially identical to the intended working surface.

12. The platform assembly of claim 2, wherein the intended working surface includes a textured surface.

13. The platform assembly of claim 2, further comprising at least one catch member pivotably coupled to the second assembly.

14. The platform assembly of claim 13, further comprising at least one stop member coupled to the second assembly and configured to maintain a rotation of the at least one catch member coupled to the second assembly at less than a full revolution.

15. A platform assembly comprising:

a first assembly having a first plurality of substantially parallel longitudinally extending members;

a second assembly having a second plurality of substantially parallel longitudinally extending members, the second assembly being longitudinally, slidably coupled with the first assembly;

at least one catch member pivotably coupled to the first assembly, wherein the at least one catch member is configured to exhibit a substantially bell-shaped geometry along a cross section taken substantially parallel to a longitudinal axis of the first plurality of longitudinally extending members; and at least one stop member coupled to the first assembly and configured to maintain a rotation of the at least one catch member at less than a full revolution.

16. The platform assembly of claim 15, wherein the at least one stop member includes a lateral support member extending through an opening defined in each of the first plurality of longitudinally extending members.

17. The platform assembly of claim 16, further comprising a plurality of spacers wherein at least one spacer of the plurality of spacers is disposed between adjacent longitudinally extending members of the first plurality of longitudinally extending members.

18. The platform assembly of claim 17, wherein each of the plurality of spacers is disposed about a portion of the lateral support member.

19. A platform assembly comprising:

a first assembly having a first plurality of substantially parallel longitudinally extending members;

a second assembly having a second plurality of substantially parallel longitudinally extending members, the second assembly being longitudinally, slidably coupled with the first assembly, wherein at least one of the first and second pluralities of longitudinally extending members exhibits a cross-sectional geometry taken substantially transverse to a longitudinal axis thereof having a first section adjacent a first end thereof, a second section adjacent a second opposing section thereof and at least a third section disposed between the first section and the second section, wherein the at least a third section exhibits a lesser width than either of the first section and the second sections;

at least one catch member pivotably coupled to the first assembly; and at least one stop member coupled to the first assembly and configured to maintain a rotation of the at least one catch member at less than a full revolution.

20. A method of securing an elevated platform, the method comprising:

providing a first elevated support;

providing a first catch member with an associated stop member on the platform;

displacing at least a first portion of the platform laterally in a first direction until the catch member is positioned substantially beyond at least a portion of the first elevated support;

displacing the at least a first portion of the platform laterally in a second direction until the first catch member engages the at least a portion of the first elevated support;

further displacing the at least a first portion of the platform laterally in the second direction while substantially simultaneously rotating the first catch member in a direction towards the associated stop member; and abutting the first catch member against the associated stop member and against the at least a portion of the first elevated support such that the first catch member prevents further displacement of the at least a first portion of the platform in the second direction.

21. The method according to claim 20, further comprising:

providing a second elevated support laterally spaced from the first elevated support;

providing a second catch member with an associated stop member on the platform;

laterally displacing a second portion of the platform relative to the at least a first portion of the platform in the second direction until the second catch member is positioned substantially beyond at least a portion of the second elevated support;

laterally displacing the second portion of the platform relative to the at least a first portion of the platform in the first direction until the second catch member engages the at least a portion of the second elevated support;

further displacing the second portion of the platform laterally relative to the at least a first portion of the platform in the first direction while substantially simultaneously rotating the second catch member in a direction towards its associated stop member; and abutting the second catch member against its associated stop member and against the at least a portion of the second elevated support such that the second catch member prevents further displacement of the second portion of the platform in the first direction.

* * * * *